US005365828A

United States Patent [19]

Sperber et al.

[11] Patent Number: 5,365,828

[45] Date of Patent: Nov. 22, 1994

[54] PNEUMATIC LINEAR DRIVE COMPRISING A LOCKING MECHANISM FOR END POSITIONS

[75] Inventors: Franz Sperber, Kolbermoor; Arno Voit, Hausham; Walter Stich, Miesbach, all of Germany

[73] Assignee: Deutsche Aerospace AG, Munich, Germany

[21] Appl. No.: 79,907

[22] Filed: Jun. 23, 1993

[30] Foreign Application Priority Data

Jun. 27, 1992 [DE] Germany ..... 4221238

[51] Int. Cl.[5] ..... F15B 15/26

[52] U.S. Cl. ..... 91/41; 91/44; 92/21 R; 92/28

[58] Field of Search ..... 91/41, 43, 44, 45; 92/29, 15, 21 R, 25, 28

[56] References Cited

U.S. PATENT DOCUMENTS

| | | | |
|---|---|---|---|
| 2,130,618 | 9/1938 | Gnavi . | |
| 2,908,251 | 10/1959 | Gratzmuller | 91/45 |
| 3,395,618 | 8/1968 | Fredd | 91/41 |
| 3,889,576 | 6/1975 | Sheffer et al. | 91/45 X |
| 4,524,676 | 6/1985 | Rogers | 91/43 |
| 4,784,037 | 11/1988 | Fabyan et al. | 91/43 |
| 5,193,431 | 3/1993 | Propsting et al. | 92/21 R X |

FOREIGN PATENT DOCUMENTS

| | | |
|---|---|---|
| 2146592 | 8/1973 | Germany . |
| 3609765 | 9/1987 | Germany . |
| 3913009 | 10/1990 | Germany . |
| 4221230 | 7/1993 | Germany . |
| 353428 | 5/1961 | Switzerland . |

*Primary Examiner*—Edward K. Look
*Assistant Examiner*—Hoang Nguyen
*Attorney, Agent, or Firm*—Evenson, McKeown, Edwards & Lenahan

[57] ABSTRACT

A linear drive is disclosed comprising a single-acting pneumatic piston cylinder unit, at least one spring which acts against the pneumatic force and loads the piston rod in the direction of one end position, and one form-locking pneumatic locking mechanism respectively for each of the two end positions of the piston rod. The locking mechanism comprises a locking link which can be locked from diametrical sides into one recess of the piston rod respectively; a first control piston which is rigidly connected with the locking link, a second larger control piston which is disposed in a longitudinally movable manner on a supporting tube rigidly connected with the locking link; a spring which presses the second control piston in the direction of its extreme end position; a stop for the second control piston which is fixed to the housing; a valve piston which is coupled in a springy and sealing manner with the second control piston and has a closable throttle duct and an open flow connection from the interior of the second control piston and of the valve piston to the pressure space of the piston cylinder unit.

9 Claims, 4 Drawing Sheets

PNEUMATIC LINEAR DRIVE COMPRISING A LOCKING MECHANISM FOR END POSITIONS

BACKGROUND AND SUMMARY OF THE INVENTION

This invention relates to a linear drive comprising a single-acting pneumatic piston cylinder unit, comprising at least one spring which acts against the pneumatic force and loads the piston rod in the direction of one end position, and comprising one form-locking pneumatic locking mechanism respectively for each of the two end positions of the piston rod.

From German Patent Document DE-OS 36 09 765, a linear drive is known which has a double-acting pneumatic piston cylinder unit and which has, in the area of the two cylinder ends, one form-locking locking mechanism respectively for each of the two end positions of the piston rod. In both positions, the locking takes place by means of springs which prestress the locking elements in the direction of the piston rod. The unlocking takes place pneumatically by overcoming the spring force, in which case the pressure gas can flow into the piston cylinder unit only after the complete unlocking and can set the piston rod into motion. In this manner, an operation is achieved which is particularly low with respect to wear and noise. The locking element, which is illustrated on the right-hand side in FIG. 1 of German Patent Document DE-OS 36 09 765, when the piston rod is moved out (from the left to the right) will rest on its surface under spring force until, when the end position is reached, it locks into the corresponding recess. In this fashion, it exercises a pressure force and a friction force on the piston rod which is suitable for damping possibly occurring slight vibrations.

A certain disadvantage of this linear drive is caused by its construction and concerns its relative large overall length.

Based on this known solution for a double-acting pneumatic linear drive, the invention is based on the object of providing a pneumatic linear drive comprising a single-acting piston cylinder unit, comprising at least one spring acting against the pneumatic force and comprising one form-locking pneumatic locking mechanism respectively for each of the two end positions of the piston rod, which is particularly compact, light, uncomplicated and operationally reliable, which can be adapted to different operating requirements by means of low expenditures, and which can be used in a wide vibration spectrum, as it occurs particularly in the surroundings of rocket engines.

This object is achieved by providing an arrangement comprising a linear drive, particularly for cryogenic control valves in liquid fuel lines of rocket engines, comprising a single-acting pneumatic piston/cylinder unit, at least one spring which acts against the pneumatic force and loads the piston rod in the direction of one end position, and a locking device including one form-locking pneumatic locking mechanism respectively for each of the two end positions of the piston rod.

The locking mechanisms for the two end positions are combined to form a locking link which locks from diametrical sides into one recess of the piston rod respectively and which has two control pistons which are applied to it, whereby a compact arrangement of the locking mechanism is achieved. The first control piston, which is smaller with respect to the cross-section acted upon by pressure, is rigidly connected with the locking link and is responsible for the locking in the pneumatically pressure-less position, that is, in the spring-actuated end position of the piston rod. With respect to a cryogenic control valve, this would preferably be the closed position of the valve.

The second control piston, which is larger with respect to the cross-section acted upon by pressure, relative to the locking link, is translatorily movable to a limited degree on a supporting tube which is rigidly connected with the locking link, in which case one stop exists that is fixed to the supporting tube and one that is fixed to the housing, and a pressure spring is arranged between the control piston and the locking link. Thus, the transmission of force between the control piston and the locking link takes place in a springy, that is, relatively soft manner.

The second larger control piston is responsible for the locking in the end position of the piston rod which is pneumatically acted upon by pressure, that is, which is active. With respect to a cryogenic control valve, this would preferably be the open position.

However, it is also responsible for the control of the supply and removal of pressure gas to the pressure space or from the pressure space of the piston/cylinder unit and for this purpose, is coupled with an additional valve piston. By means of corresponding flow ducts in the area of the valve piston, of the second control piston, of the supporting tube and of the locking link in connection with the various stops, it is achieved that the admission of pressure for activating of the piston cylinder unit takes place only after the complete unlocking of the pressure-less end position, whereby a method of operation is obtained that saves material and is largely free of jamming.

During the transition from the active into the passive position, after the unlocking of the active end position, the valve piston exposes an additional cross-section of flow between itself and the second control piston so that the movement of the piston rod takes place relatively fast.

The arrangement according to the invention has the result that each of the two control pistons is responsible for the locking in the one end position and for the unlocking in the opposite end position. The activating of the control pistons takes place actively by the one-sided pneumatic pressure admission. During every movement of the piston between the end positions, the locking link rests on one side under pneumatic or spring force against the surface of the piston rod and dampens possibly occurring vibrations by the exercised normal and frictional force.

Other objects, advantages and novel features of the present invention will become apparent from the following detailed description of the invention when considered in conjunction with the accompanying drawings.

DETAILED DESCRIPTION OF THE DRAWINGS

The linear drive 1, which is shown in its essential elements, is part of a cryogenic control valve which is not shown and by means of which the flow of a liquid supercooled rocket fuel component is blocked or released.

Figure 1:
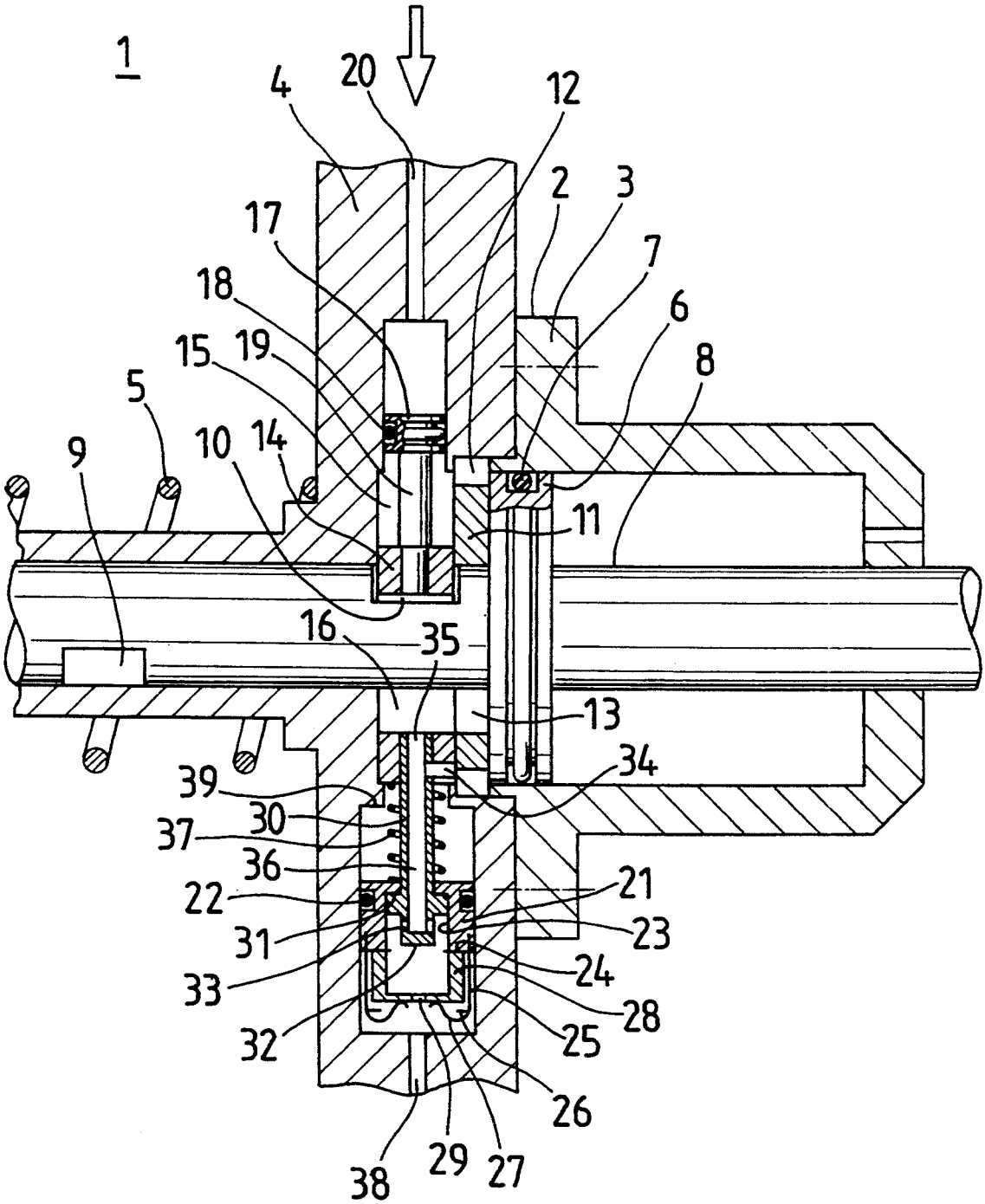
FIG. 1 is a schematic representation of a partial longitudinal sectional view of a linear drive showing the piston rod in a moved out and locked position constructed according to a preferred embodiment of the invention.
Figure 3:
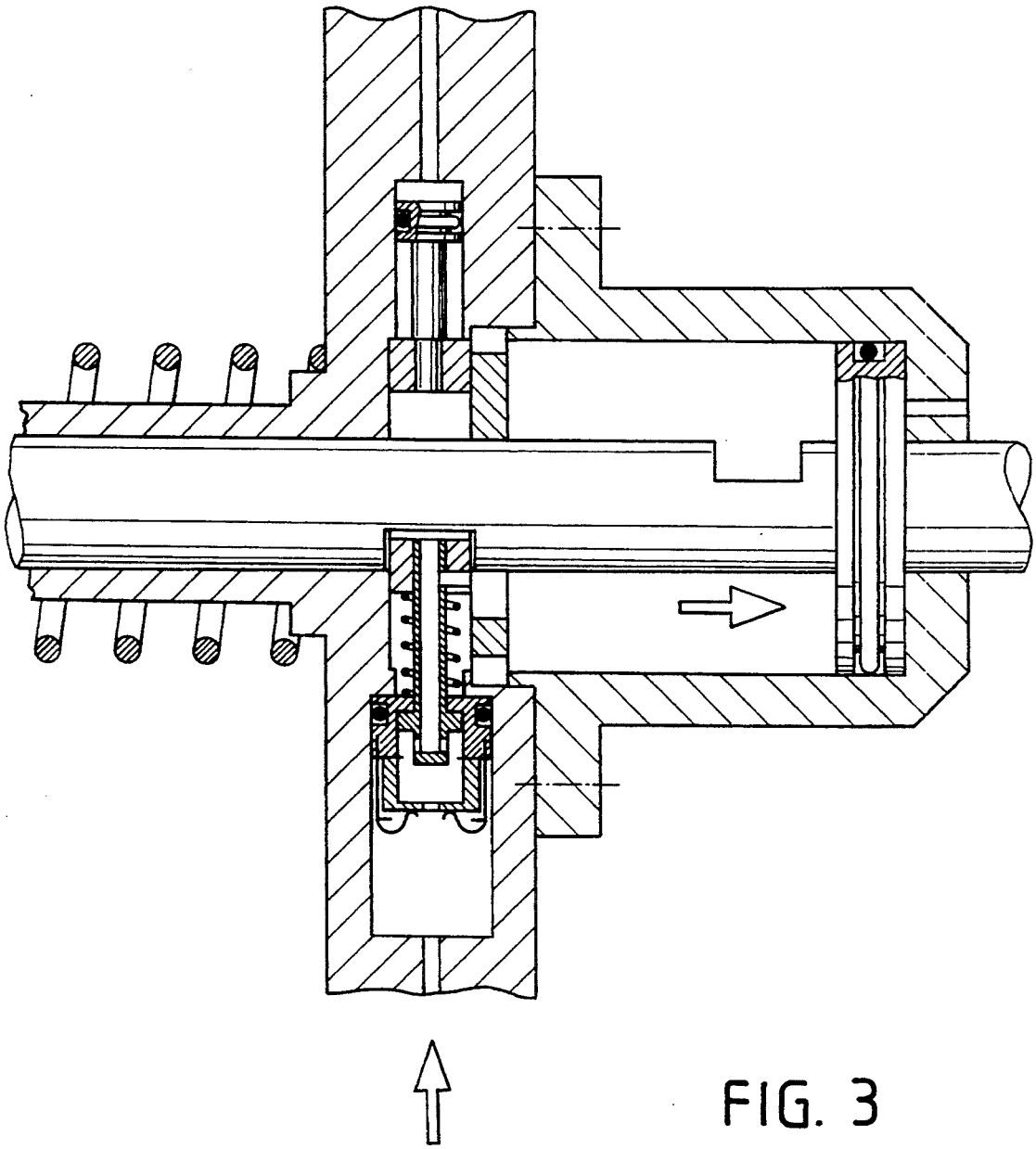
FIG. 3 is a schematic representation of a partial longitudinal sectional view of the linear drive of FIG. 1, showing the piston rod in a moved in and locked position.
Figure 4:
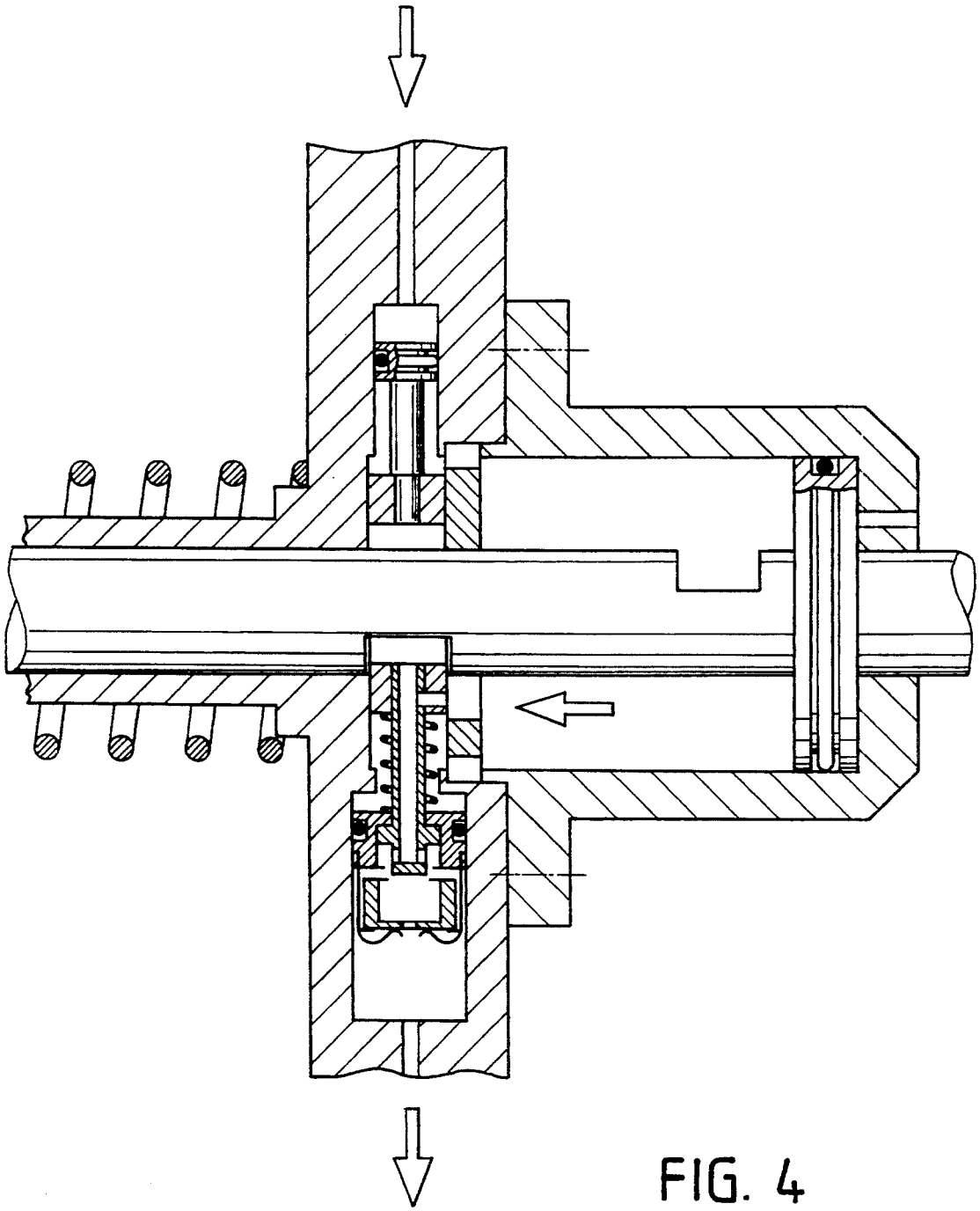
FIG. 4 is a schematic representation of a partial longitudinal sectional view of the drive of FIG. 1, showing the piston rod in a moved in and unlocked condition immediately before being moved out.

The moved-out (left) position of the piston rod 8 and of the piston 6 illustrated in FIG. 1 corresponds to the closed position of the control valve; the moved-in (right) position of the piston rod 8 illustrated in FIGS. 3 and 4 corresponds to the open position. The terms "moved-in" and "moved-out" relate to the portion of the piston rod 8 which extends from the piston 6 toward the left and which is connected with the valve body of the cryogenic control valve which is also not shown. The linear drive 1 comprises the piston cylinder unit 2 which consists essentially of the housing parts 3 and 4, the piston 6 with the sealing ring 7 and the piston rod 8.

The linear drive also comprises the spring 5 which, on its visible left end, is directly or indirectly connected with the piston rod 8 and loads this piston rod 8 against the pneumatic force in the direction of its linear end position.

The linear drive 1 also comprises the whole locking mechanism, via which the control of the piston rod movement also takes place. The housing part 3 accommodates the displacement space of the piston cylinder unit 2 and supports the right portion of the piston rod 8 which improves the rod and piston guiding but is not absolutely necessary with respect to the overall operation.

The housing part 4 accommodates the locking mechanism and carries the right end of the spring 5.

The central element of the locking mechanism is formed by the locking link 14 which can be linearly moved to a limited degree in its displacement space 15 transversely with respect to the piston rod 8 and, in the end positions of the piston rod 8, engages alternately from opposite sides form-lockingly in its recesses 9, 10. For this purpose, the locking link 14 has a recess 16 which may be closed around the piston rod or may be open on one side transversely to the moving direction of the locking mechanism. The displacement space 15 of the locking link 14 preferably has a rectangular cross-section which may have rounded edges, or an oval cross-section, whereas the displacement spaces of all existing pistons as a rule have a circular cross-section. By way of a piston rod 19, the locking link 14 is rigidly connected with a first relatively small control piston 17 which is gastightly guided in its slide way by means of a sealing ring 18. As indicated in FIGS. 1 and 4 by means of white arrows, the control piston may be acted upon through the duct 20 by pressure gas, preferably helium and, as a result, generates a force or a movement of the locking link 14 radially to the piston rod 8.

On the side which is opposite the control piston and is on the bottom in the figures, a second larger control piston 21 is arranged which, in connection with a valve piston 28, is used not only for the movement of the locking link but also for the gas control for the actual working piston, that is, piston 6. In contrast to the first control piston 17, the second control piston 21 is not rigidly connected with the locking link 14 but is disposed on a supporting tube 30 which is fixed to the locking link so that it can be axially moved to a limited degree. The end position of the control piston 21 away from the link is defined by a rigid stop 31 on the supporting tube 30 which interacts with the smaller diameter of a step bore 23 in the control piston 21. This piston position is illustrated in FIG. 1. The movement of the control piston 21 toward the locking link 14 or toward the piston rod 8 is limited twofold, specifically, on the one hand, by an impacting of the bottom of the valve piston 28 on the face 32 of the supporting tube 30; on the other hand, by the stop 39 in the housing part 4. As a result of the force of the prestressed spring finger 27 of the spring cage 25 which is fixedly connected with the control piston 21, the valve piston 28 normally rests in a gastight manner on the face 24 of the control piston 21, in which case, in this area, an additional sealing element, such as an O-ring, may be present. By a corresponding pressure effect or force effect, the valve piston 28 may be lifted off the face 24, specifically, maximally until it rests against the stop noses 26 of the spring cage 25, in which case an open cross-section of flow is created between the pistons 21 and 28. This case is illustrated in FIG. 4. It should be pointed out that the spring cage 25 is no closed pot-shaped structure but a body with several breakthroughs which lets a flow pass through. Thus, the pistons 21 and 28 usually act as an integral body; their springy connection has an effect only under certain conditions.

The transmission of force from the control piston 21 to the locking link 14 takes place in an elastically flexible manner by way of the spring 37. A relatively hard, direct transmission of force occurs only in moments, in which the bottom of the valve piston 28 rests on the face 32 of the supporting tube 30.

Figure 2:
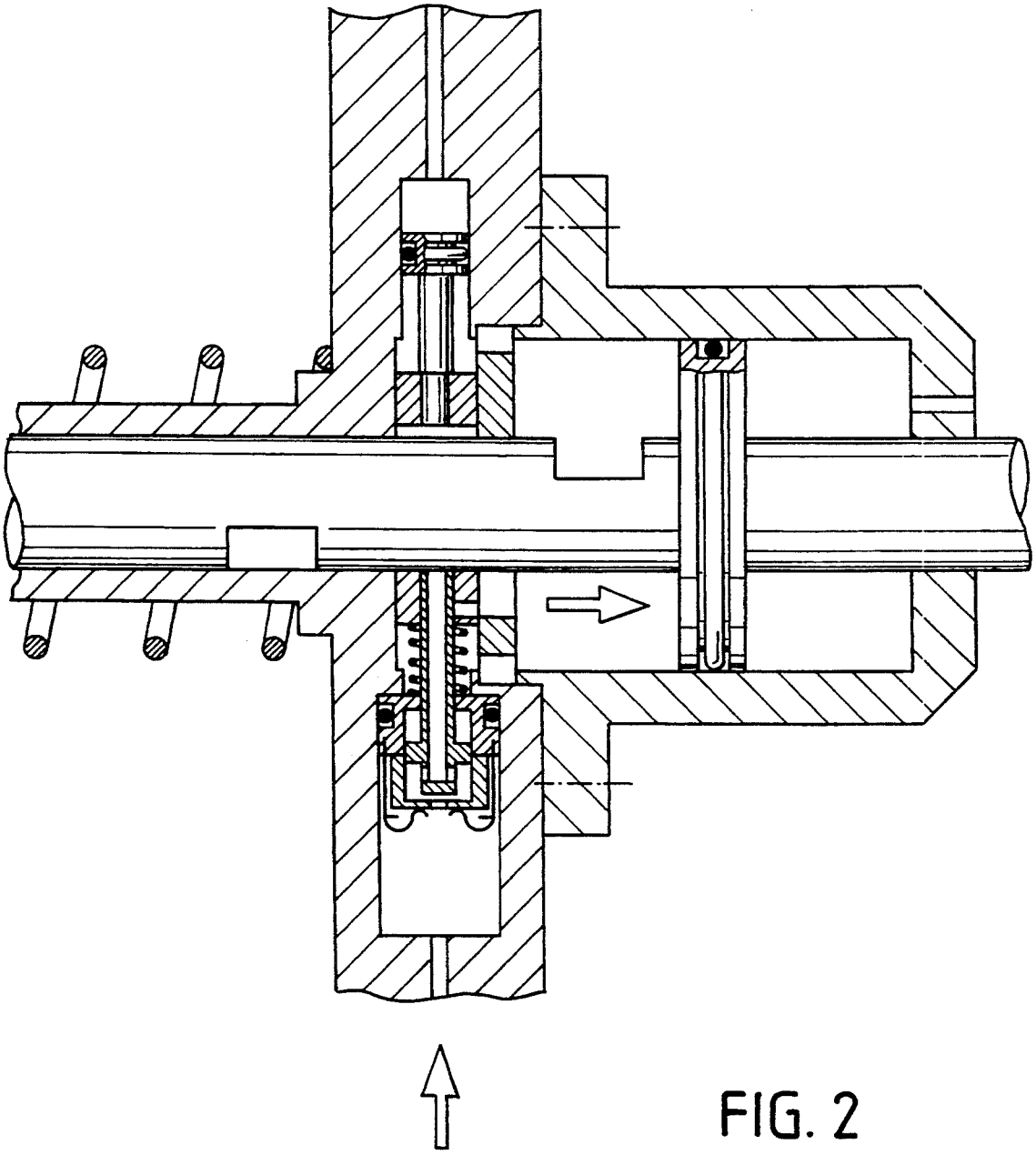
FIG. 2 is a schematic representation of a partial longitudinal sectional view of the linear drive of FIG. 1, showing the piston rod in a moved in and unlocked position.

The pressure gas supply of the piston 6 takes place through the valve piston 28 and the control piston 21; in this regard, also see FIGS. 2 and 3, in particular. A permanently open flow connection exists from the interior space of the pistons 21 and 28 to the displacement space 15 of the locking link 14 and from there further through the wall element 11 to the pressure side (left) of the piston 6. This connection starts with the openings 33 in the area of the face 32 of the supporting tube 30 and continues with the flow duct 36 in the interior of the supporting tube as well as with the openings 34 and 35 in the area of the locking link 14. Furthermore, the openings 12 and 13 in the wall element 11 are part of this flow connection. By means of the number, the size and the arrangement of the openings and ducts, the moving sequences of the piston rod 8 can be influenced, specifically also in a targeted manner as a function of the position of the locking link 14 relative to the wall element 11. However, it is only significant that the mentioned flow connection is always open. However, in certain operating conditions, the flow connection from the outside (bottom side) of the valve piston 28 into the interior space of the pistons 28 and 21 is interrupted, specifically by placing the bottom of the valve piston 28 on the face 32 of the supporting tube 30 while the throttle duct 29 is closed. In this case, the valve piston 28 must also rest gastightly on the control piston 21, in which case the latter is guided in a gastight manner in its slide way by means of a sealing ring 22. In the plurality of operating conditions, the flow connection from the duct 38 in the housing part 4 to the pressure side of the piston 6 is open, however, as illustrated in FIGS. 1 to 4.

For a better understanding, the operating conditions according to FIGS. 1 to 4 as well as their relationships will be discussed in detail in the following.

FIG. 1 shows the moved-out (left) and locked end position of the piston rod 8 which is caused by the force of the spring 5. For securing the locking, the control piston 17 is acted upon by pressure helium (see arrow); the pistons 21, 28 and 6 are "vented", that is, without pressure. Because of the force of the spring 37, the control piston 21 is in its extreme (lowest) position on the supporting tube 30 on the stop 31.

In order to release the locking mechanism and to initiate the moving-in movement of the piston rod 8, the control piston 17 is "vented", and the control piston 21 is acted upon by pressure helium. Because of the strong throttling effect of the narrow throttle duct 29, the valve piston 28, together with the control piston 21, is pushed to the stop onto the face 32 of the supporting tube 30, in which case the throttling duct 29 is closed and the spring 37 is compressed. Starting then, the pistons 21 and 28 and the supporting tube 30 will move together with the locking link 14, in which case the portion of the locking link 14 which faces the control piston 17 moves completely out of the recess 10 and thus releases the piston rod 8. The control piston 21 finally strikes against the stop 39 fixed to the housing and stops; the supporting tube 30 continues to move together with the locking link 14 to the stop on the piston rod 8, in which case the throttle duct 29 is opened up again and the pressure helium can flow to the piston 6 and initiate the moving-in movement. This condition is illustrated in FIG. 2.

Up to the stop of the control piston 21 in the housing part 4, hardly any pressure helium has flowed to the piston 6 so that the unlocking takes place largely without jamming.

FIG. 3 illustrates the locked moved-in position of the piston rod 8 with a maximally telescoped spring 5 which corresponds to the opened condition of the cryogenic control valve which is not shown. As the result of the force of the spring 37, the locking link is locked into the recess 9 of the piston rod 8; the piston 6 is pressurized.

In order to now open up this locking again and to initiate the moving-out movement, the pistons 21 and 28 are "vented", and the control piston 17 is acted upon by pressure, whereby the unlocking movement of the locking link 14 is started. As a result of the pressure which still exists in the displacement space of the piston 6 and which propagates into the area of the pistons 21 and 28, the valve piston 28 lifts off the face 24 of the control piston 21 and exposes beyond the throttle duct 29 a relatively large cross-section of flow. In this manner, a rapid pressure reduction takes place in the displacement space of the piston 6 and, after the unlocking is completed, a relatively fast moving-out movement of the piston rod 8.

FIG. 4 shows the moment of the transition from the unlocking to the moving-out movement.

In the further course, the locking link 14 is again placed against the piston rod 8 in a damping manner until it engages in the recess 10 in the moved-out end position. The frictional force in the damping phase is held at a moderate level by means of the small pressure cross-section of the control piston 17.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A linear drive for a control valve in a liquid fuel line, comprising a single-acting pneumatic piston/cylinder unit having a piston connected to a piston rod and movable in a pressure space of a piston/cylinder unit housing, at least one spring which acts against a pneumatic force in the pressure space and loads the piston rod in a direction of one end position, and a locking device including one form-locking pneumatic locking mechanism respectively for each of two end positions of the piston rod, wherein the locking device includes:

a locking link which is selectively movable from diametrical sides into one recess of the piston rod respectively; a first control piston which is rigidly connected with the locking link, a second larger control piston which is disposed in a longitudinally movable manner on a supporting tube rigidly connected with the locking link; a spring which presses the second control piston in a direction of its extreme end position; a stop for the second control piston which is fixed to the housing; a valve piston which is coupled in a springing and sealing manner with the second control piston and has a closable throttle duct and an open flow connection from an interior of the second control piston and of the valve piston to the pressure space of the piston cylinder unit.

2. A linear drive according to claim 1, wherein the control valve is a cryogenic control valve in a liquid fuel line of a rocket engine.

3. A linear drive for a control valve in a liquid fuel line comprising a single-acting pneumatic piston/cylinder unit having a piston connected to a piston rod and movable in a pressure space of a piston/cylinder unit housing at least one spring which acts against pneumatic force in the pressure space and loads the piston rod in a direction of one end position, and a locking device including one form-locking pneumatic locking mechanism respectively for each of two end positions of the piston rod, wherein the locking device includes:

a locking link selectively movable transversely with respect to the piston rod to be locked from diametrical sides into one recess respectively of the piston rod, a first control piston rigidly connected with the locking link, a second control piston which is longitudinally slidably disposed on a supporting tube rigidly connected with the locking link, a cross-section of the second control piston which is acted upon by pressure being larger than that of the first control piston, at least one spring between the second control piston and the locking link which presses the second control piston in a direction of its outer end position predetermined by a supporting tube stop on the supporting tube, a housing stop fixed to the housing which limits movement of the second control piston toward the piston rod of the piston cylinder unit, and a valve piston which is coupled with the second control piston and can be moved longitudinally between an outer position and a stop fixed to the second control piston, said valve piston being provided with at least one centric throttle duct which is biased to rest against the face of the second control piston by at least one spring, wherein a face on an extreme end of the supporting tube is provided for temporary closing of the throttle duct of the valve piston, wherein at least one flow duct is provided in the interior of the supporting tube with at least one opening in the area of the control piston and in the area of the locking link, and wherein at least one flow connection is provided between the displacement space of the locking link and the pressure space of the piston cylinder unit.

4. A linear drive according to claim 3, wherein at least one elastic sealing element is provided in a contact area of the valve piston on the second control piston.

5. A linear drive according to claim 4, wherein at least one elastic sealing element is provided for sealing off the piston of the piston/cylinder unit as well as of the first and second control pistons in their cylinder running surfaces.

6. A linear drive according to claim 5, comprising an integral construction of the stop fixed to the second control piston and of at least one spring constructed as a spring cage for the valve piston.

7. A linear drive according to claim 3, comprising an integral construction of the stop fixed to the second control piston and of at least one spring constructed as a spring cage for the valve piston.

8. A linear drive according to claim 4, comprising an integral construction of the stop fixed to the second control piston and of at least one spring constructed as a spring cage for the valve piston.

9. A linear drive according to claim 3, wherein the control valve is a cryogenic control valve in a liquid fuel line of a rocket engine.

* * * * *